United States Patent [19]

Holzmann

[11] 4,229,731

[45] Oct. 21, 1980

[54] MONOLITHIC INTEGRATED ORGAN GATE CIRCUIT

[75] Inventor: Dieter Holzmann, Freiburg-Munzingen, Fed. Rep. of Germany

[73] Assignee: ITT Industries, Inc., New York, N.Y.

[21] Appl. No.: 19,396

[22] Filed: Mar. 12, 1979

[30] Foreign Application Priority Data

Apr. 1, 1978 [DE] Fed. Rep. of Germany ..... 2814175

[51] Int. Cl.[3] ..... G10H 11/34

[52] U.S. Cl. ..... 340/365 E; 84/1.01; 84/DIG. 7; 84/DIG. 23; 307/247 A; 307/251; 340/384 E

[58] Field of Search ..... 84/1.01, 1.03, 1.24, 84/DIG. 7, DIG. 8, DIG. 22, DIG. 23; 307/205, 213, 247 R, 247 A, 251, 303, 304; 340/365 E, 384 E

[56] References Cited

U.S. PATENT DOCUMENTS

| | | | |
|---|---|---|---|
| 3,637,915 | 1/1972 | Hirano | 84/DIG. 23 |
| 3,746,775 | 7/1973 | Uchiyama | 84/DIG. 23 |
| 3,819,844 | 6/1974 | Isii | 84/DIG. 23 |
| 3,861,263 | 1/1975 | Okudaira | 84/1.01 X |
| 4,077,293 | 3/1978 | Uchiyama | 84/1.01 |
| 4,085,374 | 4/1978 | Nagahama | 84/DIG. 23 |

OTHER PUBLICATIONS

Funk-Technik, 1972, No. 17, pp. 630 and 632.

*Primary Examiner*—S. J. Witkowski

*Attorney, Agent, or Firm*—John T. O'Halloran; Peter C. Van Der Sluys

[57] ABSTRACT

This invention concerns a monolithical integrated organ gate circuit showing a load resistance common to all audio signal currents. For the suppression of any bounces possibly occurring upon the operation of a second key after a first one, there is a rest current coordinated to each audio signal current which rest current is fed to the load resistance when the related key is not operated and which rest current amounts to the mean value of the related audio signal current.

7 Claims, 8 Drawing Figures

MONOLITHIC INTEGRATED ORGAN GATE CIRCUIT

BACKGROUND OF THE INVENTION

This invention deals with a monolithic integrable organ gate circuit which replaces mechanical key contacts.

As is known from the German Technical Journal "Funk-Technik" (1972), No. 17, pp 630 and 632, a problem of suppressing the bounce arises in such a gate circuit whenever the sum audio signal is taken off and produced across a load resistor common to all audio signals. As is well-known, this bounce is due to the fact that the sum audio signal is given a d.c. voltage step upon switching each individual audio frequency signal.

For eliminating this d.c. voltage step ($-\Delta U_{DD}$) on the busbar of a load resistor, $R_L$, it is well known to raise the supply voltage $U_{DD}$ during the closure of a key contact, by the amount $+\Delta U_{DD}$, so that the mean value of this signal at the busbar will remain constant. For this purpose, and in accordance with the aforementioned reference, it is proposed to use a control circuit for increasing the output voltage in accordance with the number n of closed key contacts, to the value $U_{DD}+n\cdot\Delta U_{DD}$.

Such a control circuit, however, has the disadvantage that the supply voltage $U_{DD}$ cannot be increased at will without causing technological difficulties. For if this voltage were to be kept constant, the voltage would have to be increased externally ahead of the load resistor $R_L$, by being controlled in accordance with the number of actuated (depressed) keys. This, however, would involve more complex and expensive circuitry.

SUMMARY OF THE INVENTION

This invention relates to a monolithic integrated organ gate circuit.

According to this invention there is provided a monolithic integrated organ gate circuit with a bounce suppressing arrangement, in which the electric audio signal frequencies are taken off as a sum signal at a load resistance common to all audio signal currents for producing an acoustic audio signal chord, wherein the improvement comprises in that for each of the audio signal currents, in series with the load resistor, a first electronic switch is arranged between one terminal of a supply voltage and a reference potential, across which one of the audio signal currents is inserted into the load resistor upon depression of a key, and that a second electronic switch is arranged in parallel with the reference potential, with a rest current of such amount being fed into the load resistor via said second electronic switch and during the period outside the keying, the voltage drop across the load resistor as effected by the rest current causes a d.c. voltage component to drop off which corresponds to the mean value of the respective audio signal current.

It is the object of this invention to solve in a simple way and with respect to a constant supply voltage $U_{DD}$, the aforementioned problem of eliminating the d.c. voltage step $-\Delta U_{DD}$ upon actuation of each individual key.

BRIEF DESCRIPTION OF THE DRAWINGS

This invention will now be explained with reference to FIGS. 1 to 3*f* of the accompanying drawings, in which.

DETAILED DESCRIPTION OF THE INVENTION

Figure 1:
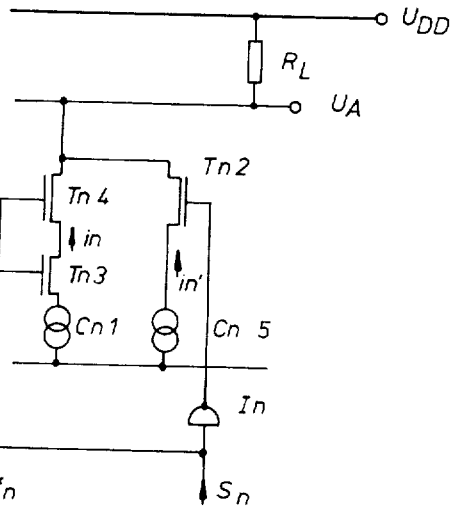
FIG. 1 explains the principles of the monolithic integrated organ gate circuit according to this invention.

With the exception of the load resistor $R_L$ which is common to all audio signal currents, FIG. 1 shows a circuit position portion as provided for each of the audio signal currents. The key signal is applied at Sn so that, upon actuation of the key (logic 1), the audio signal current is fed into the load resistor $R_L$. At the same time a rest current in', which was fed into the load resistor $R_L$ with the aid of the second electronic switch Tn2 designed as an insulated gate field-effect transistor, is interrupted. For the purpose of obtaining the audio signal current a current source Cn1 is arranged in series with a first electronic switch Tn4, whose current, in accordance with the audio signal, is modulated with the frequency fn via the gate electrode of a further insulated-gate field-effect transistor Tn3 also in series with the current source Cn1. In series with the second electronic switch Tn2 is a further current source Cn5. The key signal input Sn is connected via the inverter In to the gate electrode of the second electronic switch Tn2.

Figure 2:
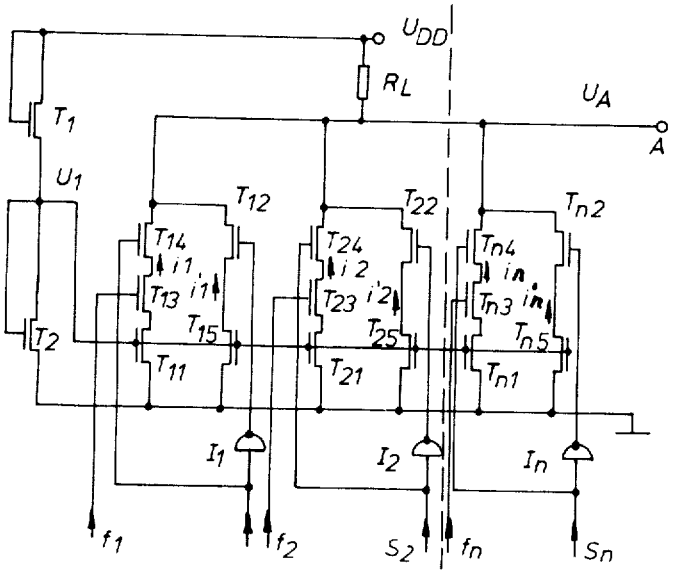
FIG. 2 shows the basic circuit diagram of a monolithic integrated organ gate circuit according to this invention employing insulated gate field-effect transistors, and FIGS. 3*a*–3*f* explain the mode of operation of the monolithic integrated organ gate circuit according to this invention.

In accordance with the circuit diagram shown in FIG. 2, the current sources Cn1 and Cn5 employ insulated gate field-effect transistors T11, T15, T21, T25; . . . Tn1, Tn5. To the gate electrodes thereof, which are galvanically connected, there is applied an almost constant voltage U1 as taken off the center switching point of a series arrangement of two insulated gate field-effect transistors T1 and T2.

The gate electrode of $T_1$ is coupled to the drain electrode which is in turn coupled to the supply voltage $U_{DD}$. The transistor $T_1$ is in series with transistor $T_2$ with the source electrode connected to the drain electrode of $T_2$. The gate electrode of $T_2$ is connected to the source electrode of $T_1$. The source electrode of $T_2$ is connected to a point of reference potential. The common connection between transistors $T_1$ and $T_2$ designated by the voltage $U_1$ is connected to the gate electrodes of transistors $T_{11}, T_{15}, T_{21}, T_{25}$ . . . Tn1, Tn5.

The output signal $U_A$ is taken off the load resistor $R_L$ at A.

The potential $U_1$ is determinative of the current within the constant-current range of the transistors, T11, T15; T21, T25; . . . Tn1, Tn5, to the gate electrodes of which this almost constant potential U1 is applied. For this purpose it is required that $$U_{Amin} > U_1 - U_T,$$

wherein $U_T$ is the threshold voltage, $U_1$ the aforementioned potential as applied to the gate electrodes of the further insulated-gate field-effect transistors used as constant-current sources.

Figure 3:
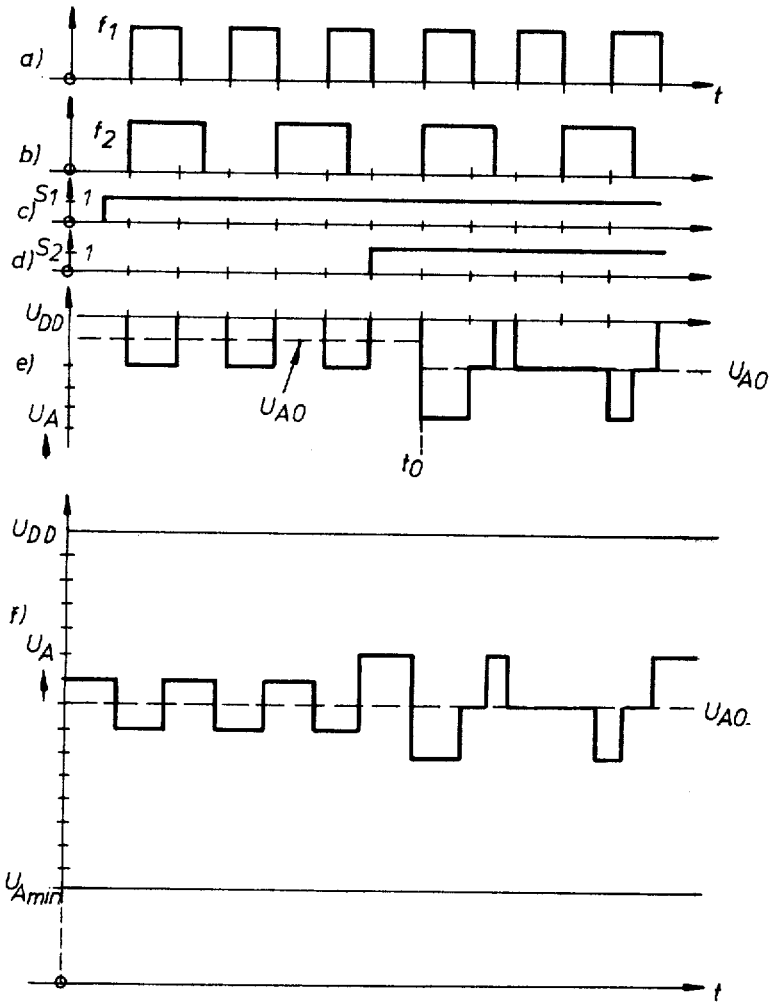

The meaning of the value $U_{Amin}$ will become evident from FIG. 3*f* which is used for the following explanation of the mode of operation of the monolithically integrated organ gate circuit according to this invention.

The waveforms f1 and f2 of two audio frequency signals normally consisting of almost rectangular impulses as shown in FIGS. 3*a* and 3*b*, for example, are keyed with respect to time in accordance with the key signals S1 and S2 as shown in FIGS. 3*c* and 3*d*.

Adding the two audio frequency signals f1 and f2 analogously at the common load resistor $R_L$ would result in a sum signal as shown in FIG. 3*e*, with the aforementioned bounce appearing at the time position $t_o$ unless steps are taken for suppressing it. In the monolithically integrated organ gate circuit according to this invention this bounce is now avoided in that simultaneously with the operation of the keys S1 and S2, there is switched off a rest current flowing in the non-operated state of the keys S1 and S2. This is illustrated in FIG. 3*f*. In the monolithically integrated organ gate circuit as shown in FIGS. 1 and 2, constant-current sources Cn1, Cn5 are arranged in the audio signal circuit as well as in the rest circuit between the reference potential and the one terminal of the load resistor $R_L$, with the constant-current sources according to the example of the embodiment shown in FIG. 2, being given by the source-drain lines of the insulated-gate field-effect transistors T11, T15; T21, T25 . . . Tn1, Tn5, to whose gate electrodes the constant potential U1 is applied in common. The rest currents $i_n'$ or $i_1'$, $i_2'$, . . . $i_n'$ are switched on with the aid of the electronic switches T12, T22, . . . Tn2 while the audio signal currents i1, i2, . . . in are switched off.

Now the potential U1 is determinative of the current flowing in the constant-current ranges of the insulated-gate field-effect transistors T11, T15; T21, T25; . . . Tn1, Tn5. For this reason there must be provided for a minimum $U_{Amin}$ according to $$U_{Amin} > U1 - U_T,$$

so that also in the case of n operated keys, the voltage range $U_{Amin} - U_{DD}$ is capable of taking up the sum signal according to FIG. 3*f*. $U_T$ indicates the threshold voltage of the insulated-gate field-effect transistors. $U_{AO}$ is the voltage level which, owing to the number of keys and the rest currents, is given by $$\sum_h i_n' = ni$$

because naturally both the number of the keys and the rest currents $i_n'$ are chosen to be equally large. Accordingly, with respect to the sum audio signal there will remain a range between $U_{DD} - U_{AO}$ on both sides of the $U_{AO}$—abscissa. This range is at $$U_{DD} - U_{AO} = 2n\, R_L i'.$$

Considering, however, that the control range is restricted by $U_{Amin} > U1 - U$, there will have to be adhered to the requirement $$U_{DD} - U_{Amin} > 2nR_L i' \quad \text{or}$$

$$i'n < (U_{DD} - U_{Amin})/2n\, R_L$$

so that the amplitudes of the signal currents as well as those of the rest currents are restricted towards above. The audio signal currents which, as such, are already chosen to be almost alike, are preferably adjusted in such a way that $i' = i/2$.

Of course, the monolithically integrated organ gate circuit according to this invention, can also be realized by using bipolar transistors as electronic switches. For this purpose, there is preferably used a space-saving layout, especially an $I^2L$-layout. As is well-known, such an integrated injection logic ($I^2L$) technique is featured by inversely operated transistors comprising n collectors arranged on the semiconductor surface, with the power supply thereof being effected via injector regions designed as emitters of lateral transistors whose base regions are applied to the emitter potential of the inversely operated transistors, and whose collector regions are constituted by the base regions of these vertically operated transistors.

While I have described above the principles of my invention in connection with specific apparatus it is to be clearly understood that this description is made only by way of example and not as a limitation to the scope of my invention as set forth in the objects thereof and in the accompanying claims.

I claim:

1. A parallel gate circuit apparatus for providing an audio tone across a common load resistor, said load resistor arranged to receive additional audio tones from additional parallel gate circuits upon receipt by said gate circuits of separate key signals for each tone, wherein said key signals can be simultaneously provided to undesirably cause an increased DC component to appear across said load resistor due to the total increase of current through said resistor upon activation of more than one key, and therefore upon activation of more than one parallel gate circuit, said gate circuit apparatus for eliminating said undesired DC component, comprising:

a selectively activated audio tone circuit path in series with said load resistor and operative when activated to provide a tone current superimposed upon a predetermined DC current to cause said superimposed current to flow through said load resistor providing an output indicative of said audio tone, a selectively operated rest current circuit path in parallel with said tone circuit path and operative when activated to cause a rest DC current to flow through said load resistor, means for applying said key signal to both said tone circuit path and said rest current path to cause said tone circuit path to activate only during the presence of said key signal and to cause said rest current path to activate only during the absence of said key signal, to cause a controlled value DC current to always flow through said load resistor corresponding to the mean value of the total audio signal current flowing therethrough, whereby a plurality of such gate circuits arranged in parallel with each other can share said common load resistor without providing said undesirable DC component during multiple key signals.

2. The gate circuit according to claim 1 wherein said selectively activated tone circuit path comprises:

a first electronic switch in series with a first current source with said source providing said superimposed current for said load resistor when said switch is operated, said switch operable in a first mode to cause said superimposed current to flow upon receipt by said switch of said key signal and to cease current flow in a second mode during the absence of said key signal.

3. The gate circuit according to claim 2 wherein said current source comprises an active device having an input control electrode adapted to receive an audio tone, a first output electrode coupled to a DC current source and a second output electrode coupled in a series path with said first electronic switch, whereby when said first electronic switch is operated in said first mode, said DC current from said source and said audio tone causes said superimposed current to flow through said load resistor.

4. The gate circuit according to claim 1 wherein said rest current circuit path includes a second electronic switch in series with a second DC current source, said second switch operative in a first mode during the absence of said key signal, to cause said second DC current to flow through said load resistor, and to cease current flow in a second mode indicative of the absence of said key signal.

5. The gate circuit according to claim 2 wherein said first electronic switch is an insulated gate FET device.

6. The gate circuit according to claim 4 wherein said second electronic switch is an insulated gate FET device.

7. The gate circuit according to claim 2 or 4 wherein said current sources are FET devices having a drain electrode coupled to a source of constant potential to cause a current to flow through said source and drain electrode.

* * * * *